US010683657B2

(12) United States Patent
Garry

(10) Patent No.: US 10,683,657 B2
(45) Date of Patent: Jun. 16, 2020

(54) BEAM SYSTEM AND METHOD OF ERECTING A SUPPORTING ARCH

(71) Applicant: QLD STEEL PTY LTD, Toowoomba (AU)

(72) Inventor: Matt Garry, Toowoomba (AU)

(73) Assignee: OVERFLOW, LTD, Weatherford, TX (US)

( * ) Notice: Subject to any disclaimer, the term of this patent is extended or adjusted under 35 U.S.C. 154(b) by 0 days.

(21) Appl. No.: 16/287,373

(22) Filed: Feb. 27, 2019

(65) Prior Publication Data

US 2019/0194931 A1 Jun. 27, 2019

Related U.S. Application Data

(63) Continuation of application No. 15/328,600, filed as application No. PCT/AU2016/050168 on Mar. 9, 2016, now Pat. No. 10,260,226.

(30) Foreign Application Priority Data

Mar. 9, 2015 (AU) ..... 2015900830

(51) Int. Cl.
*E04B 1/32* (2006.01)
*E04H 6/44* (2006.01)
(Continued)

(52) U.S. Cl.
CPC ..... *E04B 1/32* (2013.01); *E04B 1/2403* (2013.01); *E04B 1/3205* (2013.01); *E04B 1/342* (2013.01);
(Continued)

(58) Field of Classification Search
CPC ..... E04B 1/342; E04B 1/3533; E04B 2001/3241; E04B 1/3441; E04B 1/3205; E04C 3/40; E04C 3/005; E04C 2/405
See application file for complete search history.

(56) References Cited

U.S. PATENT DOCUMENTS 3,785,108 A 1/1974 Satchell
4,156,433 A 5/1979 Beaulieu
(Continued)

FOREIGN PATENT DOCUMENTS

CH 378519 A 6/1964
WO 1966001930 A1 1/1966

OTHER PUBLICATIONS

International Search Report issued in related international application No. PCT/AU2016/050168 dated May 17, 2016 (4 pages).
(Continued)

*Primary Examiner* — Gisele D Ford

(74) *Attorney, Agent, or Firm* — Ferguson Braswell Fraser Kubasta PC

(57) ABSTRACT

A beam system and method of erecting a supporting arch enables large roofed structures to be erected quickly and economically. The method includes aligning a plurality of structural elements longitudinally; connecting upper corners of the structural elements to upper corners of adjacent structural elements, wherein adjacent lower corners of the structural elements remain unconnected; elevating first and second structural elements in a middle of the supporting arch; connecting lower corners of the first and second structural elements together; elevating third and fourth structural elements adjacent the first and second structural elements, respectively; and connecting lower corners of the third and fourth structural elements to lower corners of the first and second structural elements, respectively.

14 Claims, 9 Drawing Sheets

(51) Int. Cl.

| | |
|---|---|
| ***E04C 3/40*** | (2006.01) |
| ***E04B 1/342*** | (2006.01) |
| ***E04B 1/35*** | (2006.01) |
| ***E04H 3/14*** | (2006.01) |
| ***E04B 1/24*** | (2006.01) |
| ***E04B 1/344*** | (2006.01) |
| *E04B 7/08* | (2006.01) |
| *E04C 3/11* | (2006.01) |

(52) U.S. Cl.

CPC ..... *E04B 1/3441* (2013.01); *E04B 1/3533* (2013.01); *E04C 3/40* (2013.01); *E04H 3/14* (2013.01); *E04H 6/44* (2013.01); *E04B 7/08* (2013.01); *E04B 2001/2433* (2013.01); *E04B 2001/2457* (2013.01); *E04B 2001/2463* (2013.01); *E04B 2001/2493* (2013.01); *E04B 2001/3276* (2013.01); *E04B 2001/3288* (2013.01); *E04C 3/11* (2013.01)

(56) References Cited

U.S. PATENT DOCUMENTS

| | | | |
|---|---|---|---|
| 4,244,384 | A | 1/1981 | Bean |
| 4,335,555 | A | 6/1982 | Southerland et al. |
| 4,673,308 | A | 6/1987 | Reilly |
| 4,676,045 | A | 6/1987 | Ellen |
| 5,159,790 | A | 11/1992 | Harding |
| 5,890,339 | A | 4/1999 | Willis |
| 5,983,577 | A | 11/1999 | Hays |
| 6,401,422 | B1 | 6/2002 | Olden |
| 7,533,498 | B2 | 5/2009 | Zeigler |
| 2002/0116893 | A1 | 8/2002 | Waldrop |
| 2003/0031077 | A1 | 2/2003 | Emms |
| 2004/0173252 | A1 | 9/2004 | Bouchard |
| 2008/0010912 | A1 | 1/2008 | Hanson et al. |
| 2008/0092481 | A1 | 4/2008 | Ellen |
| 2008/0115427 | A1 | 5/2008 | Wheeler |
| 2011/0113725 | A1 | 5/2011 | Garry |
| 2011/0252717 | A1 | 10/2011 | Fernandez |
| 2012/0272607 | A1 | 11/2012 | Cooper et al. |
| 2013/0263548 | A1 | 10/2013 | Merrifield |
| 2013/0334159 | A1 | 12/2013 | Daas et al. |
| 2014/0130436 | A1 | 5/2014 | Gulbrandsen et al. |
| 2014/0373471 | A1 | 12/2014 | Knepp et al. |

OTHER PUBLICATIONS

Written Opinion of the International Searching Authority issued in related international application No. PCT/AU2016/050168 dated May 17, 2016 (5 pages).

BEAM SYSTEM AND METHOD OF ERECTING A SUPPORTING ARCH

This application is a continuation application of U.S. patent application Ser. No. 15/328,600, now U.S. Pat. No. 10,260,226, filed Jan. 24, 2017.

FIELD OF THE INVENTION

The present invention relates generally to building components used in the building industry; in particular, although not exclusively, the invention relates to beams for the construction of buildings such as aircraft hangers with roofs spanning large distances.

BACKGROUND TO THE INVENTION

Many instances in building construction require roofs covering large areas that are not obstructed with intermediate vertical supporting members such as columns. An example is a sporting or events stadium, where unobstructed views can be sold for premium prices. Seats in stadia with obstructed views are sold much more cheaply than those with a clear view. Another example of such a building is an aircraft hangar that must be wide enough and high enough to accommodate an aircraft having a large wing span and a high tail structure. This is especially true with the advent of so called "super-jumbos" such as the Airbus A380.

Various geometric shapes have been proposed in the prior art for roof structures that effectively cover a large area at a relatively low cost and without the use of intermediate supports. Longitudinal roof spans supported by a series of identical arches can be effective for aircraft hangers, but such roofs also can be expensive and difficult to erect.

Large building structures often take considerable time and manpower to erect. Furthermore, the process of erecting such structures generally requires the use of expensive and skill-intensive tools and equipment, such as large cranes, and significantly skilled labour and engineering resources. Such tools, equipment and resources are often not readily available in many locations, such as developing countries, which further adds to the time and expense required for erecting such structures, and/or limits opportunities to use such structures.

There is therefore a need for an improved beam system and method of erecting a supporting arch.

SUMMARY OF THE INVENTION

In one form, although not necessarily the only or the broadest form, the invention resides in a beam system, comprising:

a first structural element; and a second structural element;

wherein each of the first and second structural elements comprises a first end and a second end, and each of the first end and the second end comprises an upper corner and a lower corner;

wherein each of the first and second structural elements comprises clevis components at each of the upper and lower corners, such that each of the first and second structural elements is attachable to four clevis joints; and wherein a clevis component at the upper corner of the second end of the first structural element is connected to a clevis component at the upper corner of the first end of the second structural element, and a clevis component at the lower corner of the second end of the first structural element is connected to a clevis component at the lower corner of the first end of the second structural element.

Preferably, the clevis components comprise a dual flange or a tang.

Preferably, each of the clevis joints comprises either two interconnected dual flanges having coaxially aligned holes, or a dual flange and a tang having coaxially aligned holes.

Preferably, each of the clevis joints further comprises a clevis pin or bolt, a retainer and a nut.

Preferably, the retainer comprises a shaft locking pin, split cotter pin, an R-clip, a rivet, or a bolt and nut.

Preferably, each of the clevis pins comprises a shaft locking pin.

Preferably, a flange on an upper corner is integrally formed with a flange on an adjacent lower corner of a single structural member.

Preferably, the beam system defines a supporting arch having a plurality of structural elements.

Preferably, the beam system defines a supporting arch, and includes at least six structural elements.

Preferably, the supporting arch is connected to a pair of footers.

Preferably, each footer in the pair of footers is connected to a structural element that comprises three clevis components.

Preferably, the supporting arch is connected to an adjacent supporting arch by a plurality of stabilising members.

Preferably, distal ends of the stabilising members are each connected to a distal end of a clevis pin connecting one of the clevis joints.

Preferably, both of the first and second structural elements are straight.

Preferably, both of the first and second structural elements are curved.

Preferably, the first structural element is straight and the second structural element is curved.

Preferably, the first structural element is curved and the second structural element is straight.

A method for erecting the supporting arch as defined above, comprising:

aligning the plurality of structural elements longitudinally;

connecting clevis components at the upper corners of the plurality of structural elements to clevis components at adjacent upper corners of adjacent structural elements before erecting the supporting arch;

elevating first and second structural elements in a middle of the supporting arch, wherein the clevis components at the lower corners of the plurality of structural elements remain unconnected; and connecting clevis components at the lower corners of the first and second structural elements to clevis components at adjacent lower corners of adjacent structural elements.

Prerably, the method further comprises connecting roof sheeting to the plurality of structural elements before elevating the structural elements.

Preferably the method further comprises sequentially elevating additional structural elements and connecting the clevis components at the lower corners of adjacent structural elements until the supporting arch is fully erected.

Preferably, some of the structural elements are pulled together horizontally, using for example a cable, winch and dollies, to assist in lifting other structural elements vertically.

According to another aspect, the present invention includes a method for erecting a supporting arch, comprising:

aligning a plurality of structural elements longitudinally;

connecting upper corners of the structural elements to upper corners of adjacent structural elements, wherein adjacent lower corners of the structural elements remain unconnected;

elevating first and second structural elements in a middle of the supporting arch;

connecting lower corners of the first and second structural elements together;

elevating third and fourth structural elements adjacent the first and second structural elements, respectively; and connecting lower corners of the third and fourth structural elements to lower corners of the first and second structural elements, respectively.

BRIEF DESCRIPTION OF THE DRAWINGS

By way of example only, preferred embodiments of the invention will be described more fully hereinafter with reference to the accompanying figures, wherein.

DETAILED DESCRIPTION OF THE PREFERRED EMBODIMENT

Figure 1:
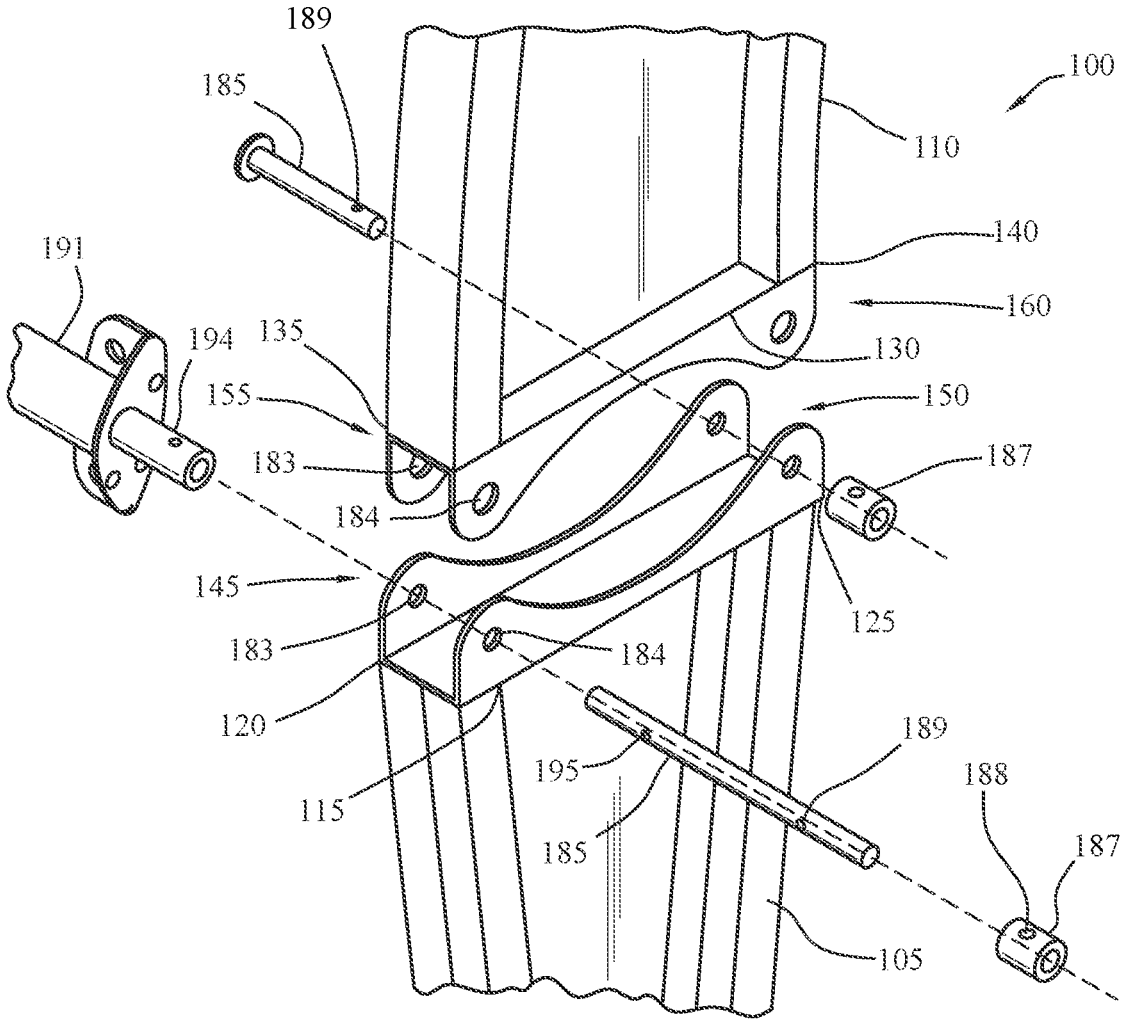
FIG. 1 shows a perspective view of an exploded, truncated section of a beam system constructed according to an embodiment of the present invention.

The present invention relates to an improved beam system and method of erecting a supporting arch. Elements of the invention are illustrated in concise outline form in the drawings, showing only those specific details that are necessary to understanding the embodiments of the present invention, but so as not to clutter the disclosure with excessive detail that will be obvious to those of ordinary skill in the art in light of the present description.

In this patent specification, adjectives such as first and second, left and right, top and bottom, upper and lower, etc., are used solely to define one element or method step from another element or method step without necessarily requiring a specific relative position or sequence that is described by the adjectives. Words such as "comprises" or "includes" are not used to define an exclusive set of elements or method steps. Rather, such words merely define a minimum set of elements or method steps included in a particular embodiment of the present invention.

According to one aspect, the present invention is defined as a beam system. The beam system comprises a first structural element and a second structural element. Each of the first and second structural elements comprises a first end and a second, and each of the first end and the second end comprises an upper corner and a lower corner. Each of the first and second structural elements comprises clevis components at each of the upper and lower corners, and each of the first and second structural elements is attachable to four clevis joints. A clevis component at the upper corner of the second end of the first structural element is connected to a clevis component at the upper corner of the first end of the second structural element. Further, a clevis component at the lower corner of the second end of the first structural element is connected to a clevis component at the lower corner of the first end of the second structural element.

Advantages of embodiments of the present invention include a beam system which, in use, can be connected to further beam systems simply and quickly, and without the need for expensive tools, equipment or skilled labour resources, to define and raise a supporting arch, and to define and raise an entire roofed structure supported by a plurality of supporting arches.

Further advantages of embodiments of the present invention include the fact that structural elements of the beam systems can be readily manufactured at low cost and packaged in a compact manner that reduces transportation costs. Further, the beam systems can be readily disassembled and stored or transported for later re-use.

FIG. 1 shows a perspective view of an exploded, truncated section of a beam system 100 comprising a first structural element 105 and a second structural element 110. The first structural element 105 comprises a first end (not shown) and a second end 115. The first structural element 105 is generally rectangular and the first end of the first structural element 105 is generally identical to the second end 115, which comprises an upper corner 120 and a lower corner 125. The second structural element 110 is also generally rectangular and comprises a first end 130 and a second end (not shown, but which is generally identical to the first end 130, but with a wider or narrower flange width to accommodate a reciprocal flange outside or inside the first flange). The first end 130 of the second structural element 110 comprises an upper corner 135 and a lower corner 140.

The first and second structural elements 105, 110 define rectangular beams fabricated using any conventional beam materials and configurations such as steel tube stock, lengths of I-beam, or solid beam lengths. As will be appreciated by those skilled in the art, dimensions of the first and second structural elements 105, 110 can be varied to suit particular requirements for length, strength, beam moment of inertia, and other specifications as demanded by a particular application.

Figure 4:
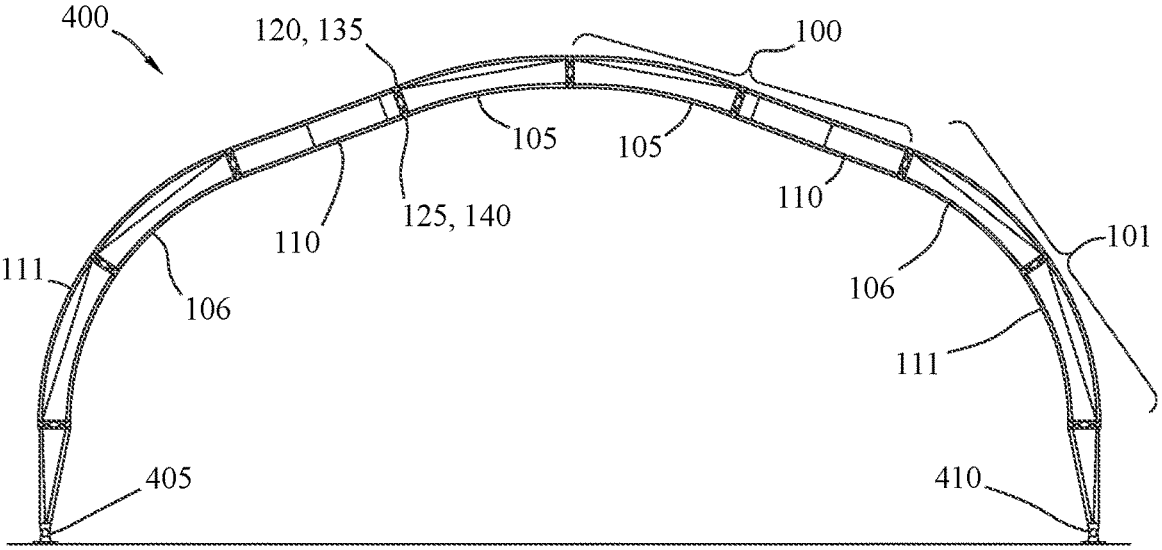
FIG. 4 shows a front view of a plurality of structural elements connected together to form a supporting arch in accordance with an embodiment of the present invention.

The first structural element 105 and second structural element 110 each comprise clevis components 145, 150, 155, 160 at each of the upper and lower corners 120, 125, 135, 140. The first structural element 105 and the second structural element 110 are each attached to four clevis joints (as illustrated in FIG. 4). In FIG. 1 the clevis joints are shown in an exploded view to better illustrate the individual components.

The clevis component 145 at the upper corner 120 of the second end 115 of the first structural element 105 is defined by a dual steel flange and is connected to the clevis component 155 at the upper corner 135 of the first end 130 of the second structural element 110. Further, the clevis component 150 at the lower corner 125 of the second end 115 of the first structural element 105 is connected to the clevis component 160 at the lower corner 140 of the first end 130 of the second structural element 110.

Figure 3:
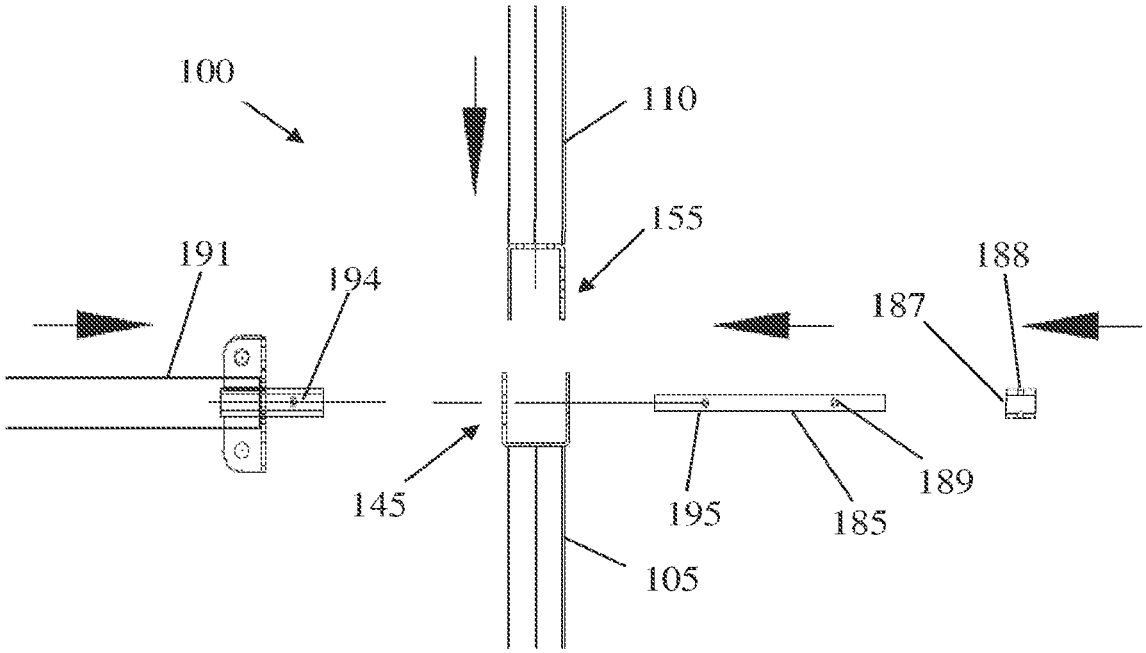
FIG. 3 shows a side view of the exploded, truncated section of the beam system shown in FIG. 1.

To define a clevis joint, the dual flanges of two clevis components 145, 155 or 155, 160 are interconnected. For example, (and as best illustrated in FIG. 3) a width between the dual flanges of the clevis component 145 can be slightly greater than a width between the dual flanges of the clevis component 155 to enable the clevis component 155 to fit into the clevis component 145. Alternatively, as is well known in the art, a clevis joint can be defined by a dual flange and a tang (not shown) positioned in the middle of the dual flange. Various other clevis joint configurations, which allow rotation about some axes while restricting rotation about other axes, also may be used.

The clevis components 145, 150, 155, 160 have coaxially aligned holes 183, 184 in their dual flanges. Furthermore, each of the clevis joints comprises a clevis pin 185, a retainer (not shown) and a nut 187. Each clevis pin 185 is positioned in coaxially aligned holes 183, 184 and secures together two adjacent clevis components (such as the clevis components 145, 155). The retainer may include various types of fasteners such as a shaft locking pin, split cotter pin, an R-clip or a rivet, or a nut. In the present embodiment a retainer such as an R-clip is positioned through holes 188 in the nut 187 and a hole 189 in the clevis pin 185 to secure the nut 187 to the pin 185.

As described in further detail below, in some embodiments an end of a stabilising member 191 is used to secure a second end of a clevis pin 185. A retainer (not shown) is positioned through holes 194 in the stabilising member 191 and a hole 195 in the clevis pin 185.

Figure 2:
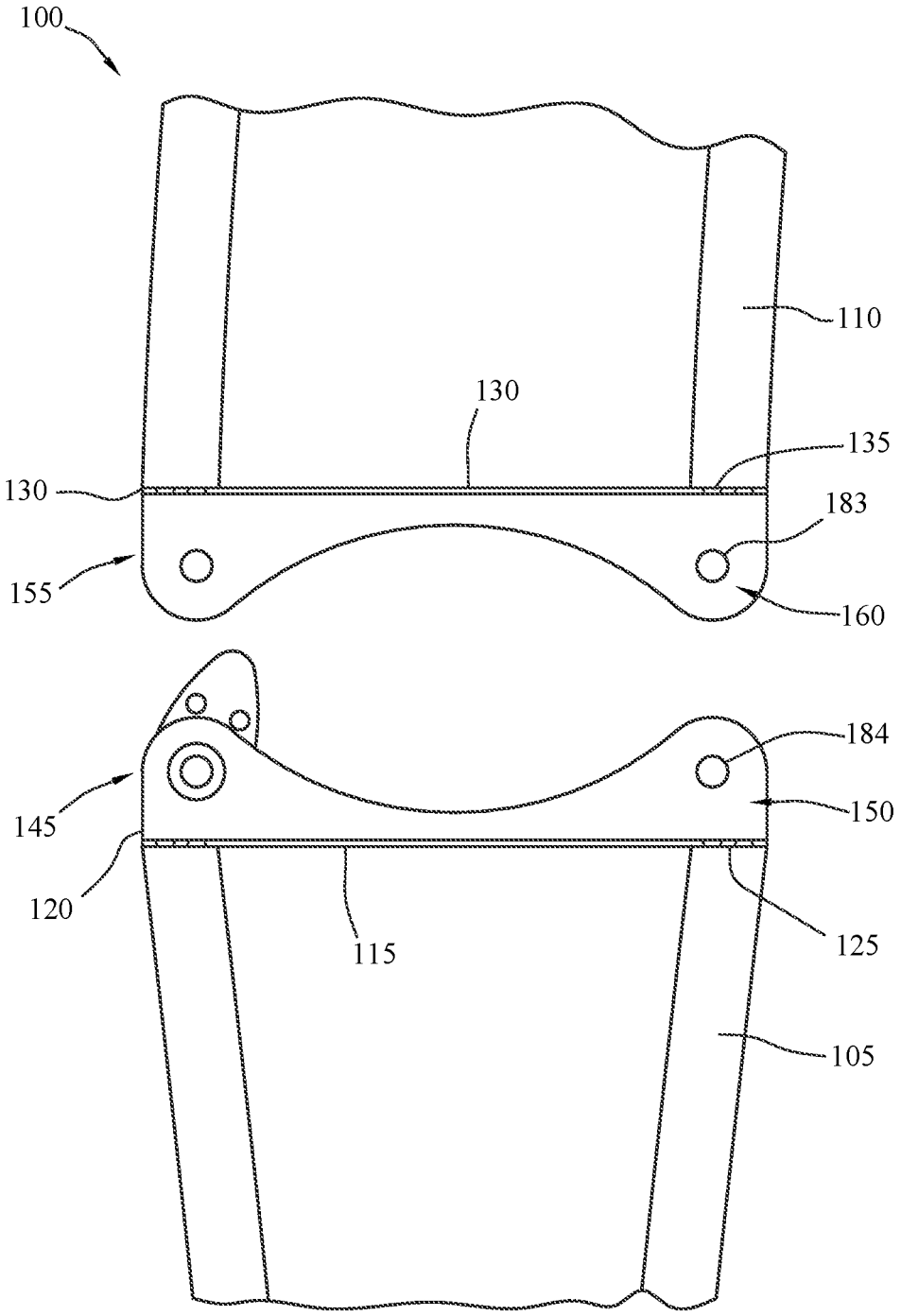
FIG. 2 shows a front view of the exploded, truncated section of the beam system shown in FIG. 1.

FIG. 2 illustrates a front view of the exploded, truncated section of the beam system 100.

FIG. 3 illustrates a side view of the exploded, truncated section of the beam system 100. As shown, the spacing between the dual flanges of the clevis component 145 is configured to receive the dual flanges of the clevis component 145. Once assembled, the elements shown in FIG. 3 define a clevis joint. The stabilising member 191 can be used to stabilise a supporting arch (which includes the first and second structural elements 105, 110) relative to an adjacent supporting arch. Advantageously, interconnecting the first structural element 105, the second structural element 110 and the stabilising member 191 can be done simply and easily and without the use of expensive machinery or highly skilled labour.

FIG. 4 shows a front view of a plurality of beam systems 100, 101 connected together to form a supporting arch 400 in accordance with embodiments of the present invention. Structural elements 105, 110 defining beams systems 100 are aligned end to end and connected together using assembled clevis joints at upper corners 120, 135 and lower corners 125, 140, as described above. Thus each structural element 105, 110 is secured by four assembled clevis joints, one at each corner of each structural element 105, 110. Similarly, other structural elements 106, 111 defining lower, more curved beam systems 101 are also connected together and to the adjacent beam systems 100 to define the supporting arch 400.

As shown, a combination of straight and curved structural elements can be used to define the outer shape of the supporting arch 400. Alternatively, all of the structural elements 105, 110 can be curved or all can be straight. Advantageously, curved structural members 105, 110 can result in an increase in the flexural strength of the supporting arch 100. A person skilled in the art will appreciate that this is important for large building structures that can be exposed to extreme weather conditions such as strong winds, heavy downpours and/or snow, which can subject the structures to considerable force.

Furthermore, the supporting arch 400 is connected to a pair of footers 405, 410 at ground level.

Figure 5:
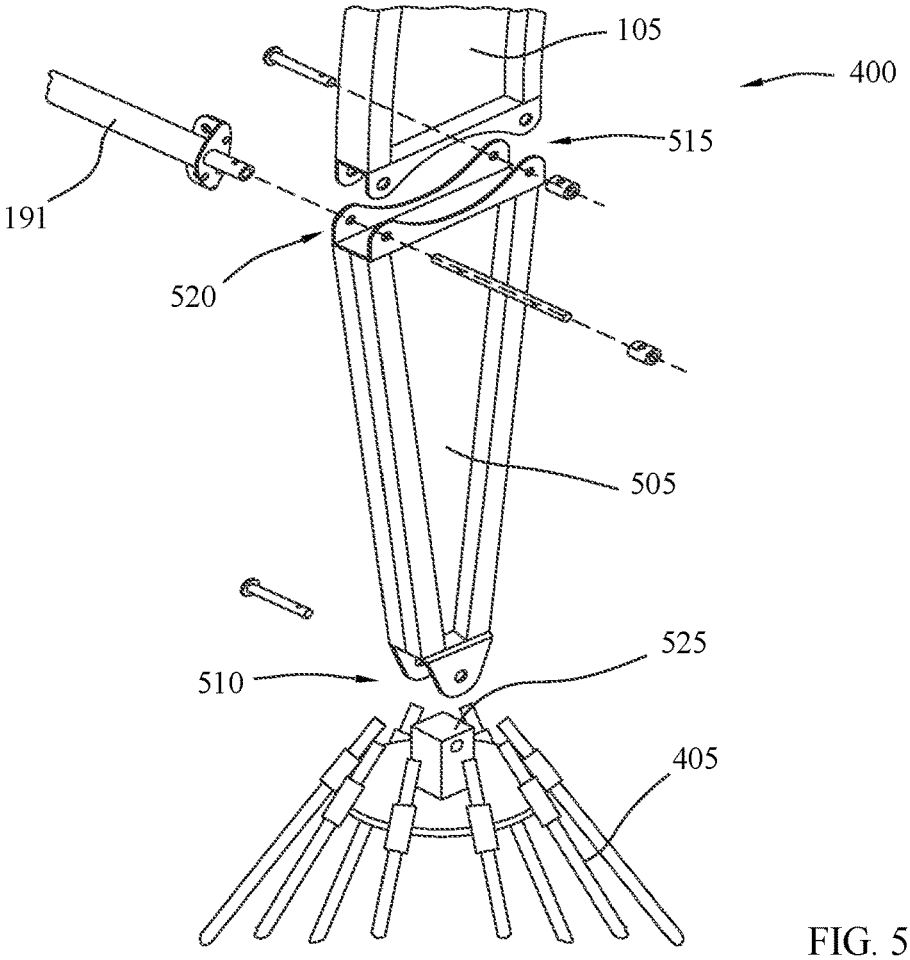
FIG. 5 shows an exploded, truncated, perspective view of a lower section of the supporting arch shown in FIG. 4, including a footer, in accordance with an embodiment of the present invention.

FIG. 5 shows an exploded, truncated, perspective view of a lower section of the supporting arch 400 including the footer 405, in accordance with the present invention. As shown, a structural element 505 comprises three clevis components 510, 515, 520. The clevis component 510 is secured to a centre post 525 of the footer 405, and the clevis components 510, 520 are secured to an adjacent structural element 105 according to the teachings above. The stabilising member 191 (of which only one end is shown) can be used to connect the supporting arch 400 to an adjacent, identical supporting arch 400 (not shown), where the two arches 400 are parallel to each other.

Figure 6:
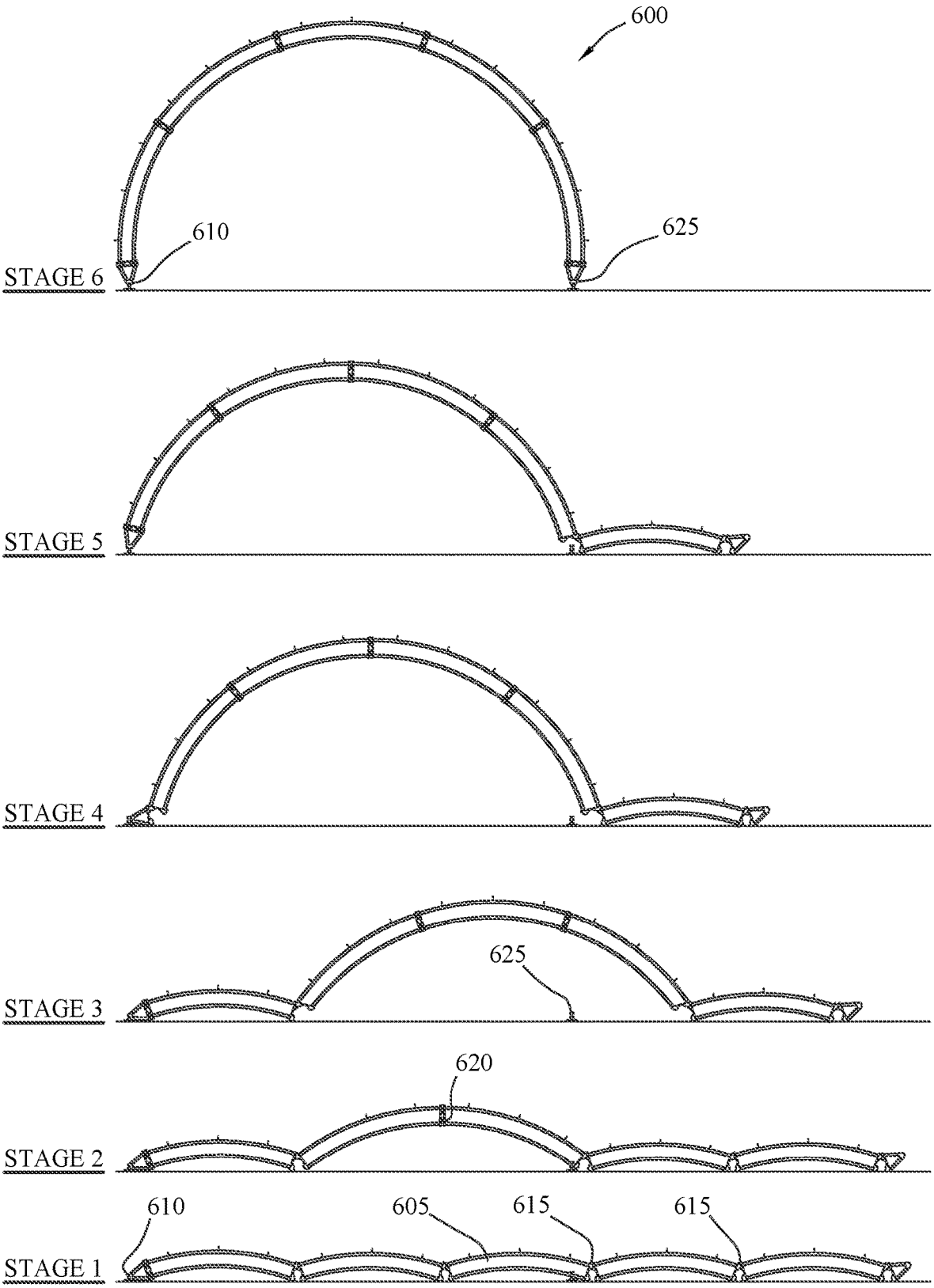
FIG. 6 shows a front view of a supporting arch illustrating the sequence of stages for erecting and connecting together a plurality of structural elements of the arch according to a method of an embodiment of the present invention.

FIG. 6 shows a front view of a construction plan illustrating a series of stages 1 to 6 for sequentially connecting five identical structural elements 605, together to erect a structural arch 600, according to a method of an embodiment of the present invention. The structural arch 600 is similar to the structural arch 400, but all of the structural elements 605 are identical. As shown at Stage 1, a first structural element 605 at the far left is first connected to a left footer 610, which can be similar to the footer 405. All five structural elements 605 are then laid on the ground, end to end, and upper clevis joints 615 on each element 605 are connected. At Stage 2, the second and third elements 605 from the left are lifted and a lower clevis joint 620 is connected together to prevent further rotation of the second element 605 relative to the third element 605. "Dollies" and wheels combined with cables and winches (not shown) can be used to pull the right most structural elements 605 horizontally toward the left most elements 605 to assist in erecting the arch 600. The ability to pull the structural elements 605 together horizontally to assist in lifting other structural elements 605 vertically enables the arch 600 to be raised without the use of large cranes or other overhead equipment. At stages 3-6 the process continues until the right most element 605 has moved fully to the left and is ready to be connected to a right footer 625.

Figure 7:
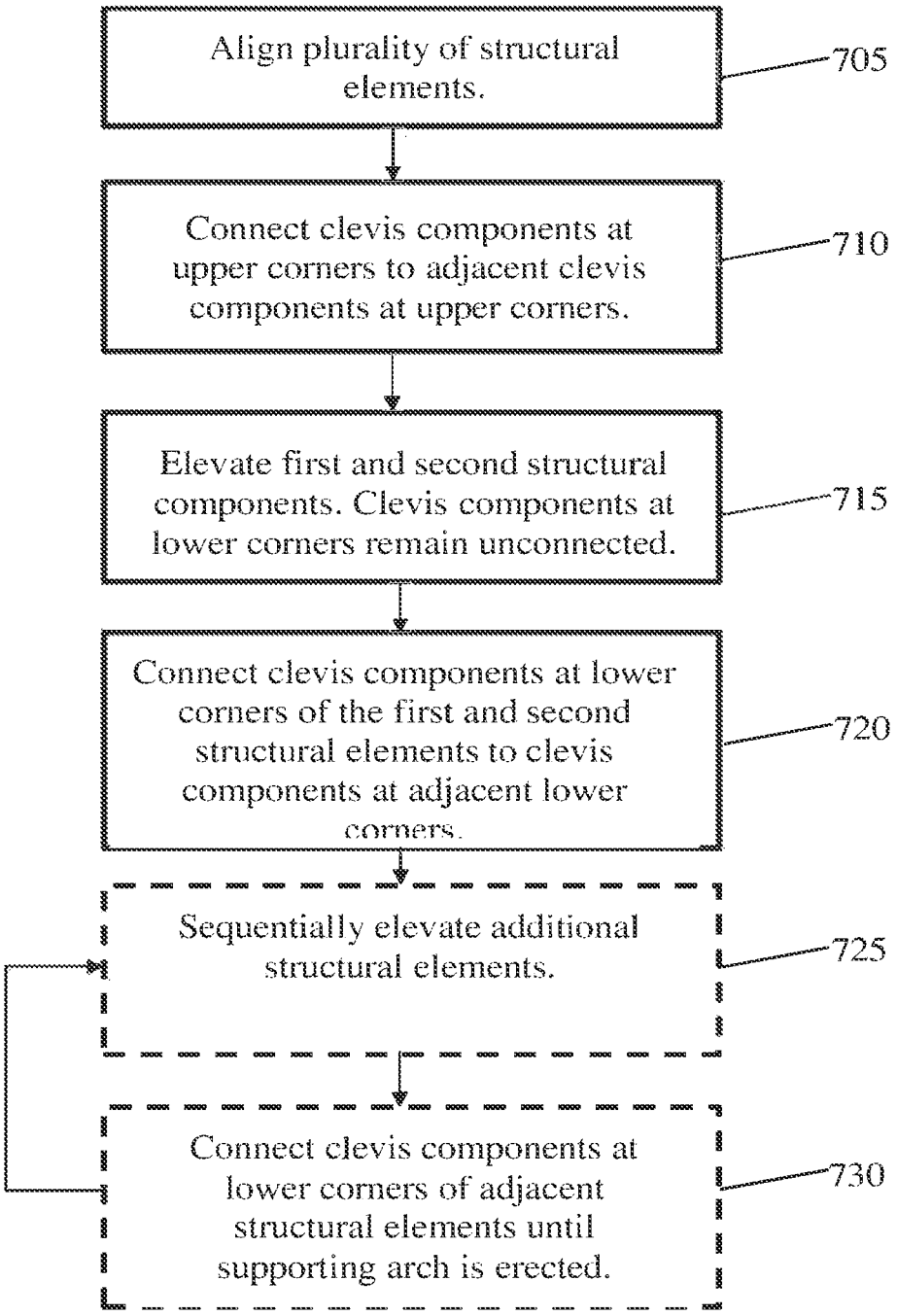
FIG. 7 shows a flow diagram of the method for erecting and connecting together the plurality of structural elements of the arch shown in FIG. 6.

FIG. 7 illustrates a flow diagram of a method 700 for erecting the supporting arch 600, according to some embodiments. Block 705 comprises aligning the structural elements 605 that define a plurality of beam systems longitudinally (see Stage 1 of FIG. 6). Block 710 involves connecting together clevis components (similar to the clevis components 145, 155) at the upper corners of each of the structural elements 605, while leaving the clevis components at the lower corners unconnected.

At block 715, the structural elements 605 in a middle of the supporting arch 600 are elevated (see Stage 2 of FIG. 6). At block 720, the clevis components at the lower corners of the structural elements 605 in the middle of the supporting arch 600 are then connected.

According to some embodiments, roof sheeting (not shown) such as sheet steel can be attached to the structural elements 605 at ground level before the structural elements 605 are elevated, where the roof sheeting extends across multiple, parallel supporting arches 600. The roof sheeting is then also lifted along with supporting arches during erection of a structure. The multiple, parallel supporting arches 600 are thus assembled and erected simultaneously, where each stage shown in FIG. 6 is completed on each of the multiple, parallel supporting arches 600 before advancing to the next stage. This can be very advantageous, as it avoids the requirement for specialised equipment for working at heights, such as cranes and scaffolding, and also avoids various risks associated with working at heights.

The method 700 continues at block 725, where additional structural elements 605 are sequentially elevated (see Stage 3 of FIG. 6). At block 730, the lower clevis joints 620 of additional elements 605 are connected together. Block 725 and block 730 are then repeated until the entire structural arch 600 is fully erected (see Stages 4 to 6 of FIG. 6). Once fully erected, the supporting arch 600 is connected to the right footer 625, as shown in FIG. 6.

Figure 8:
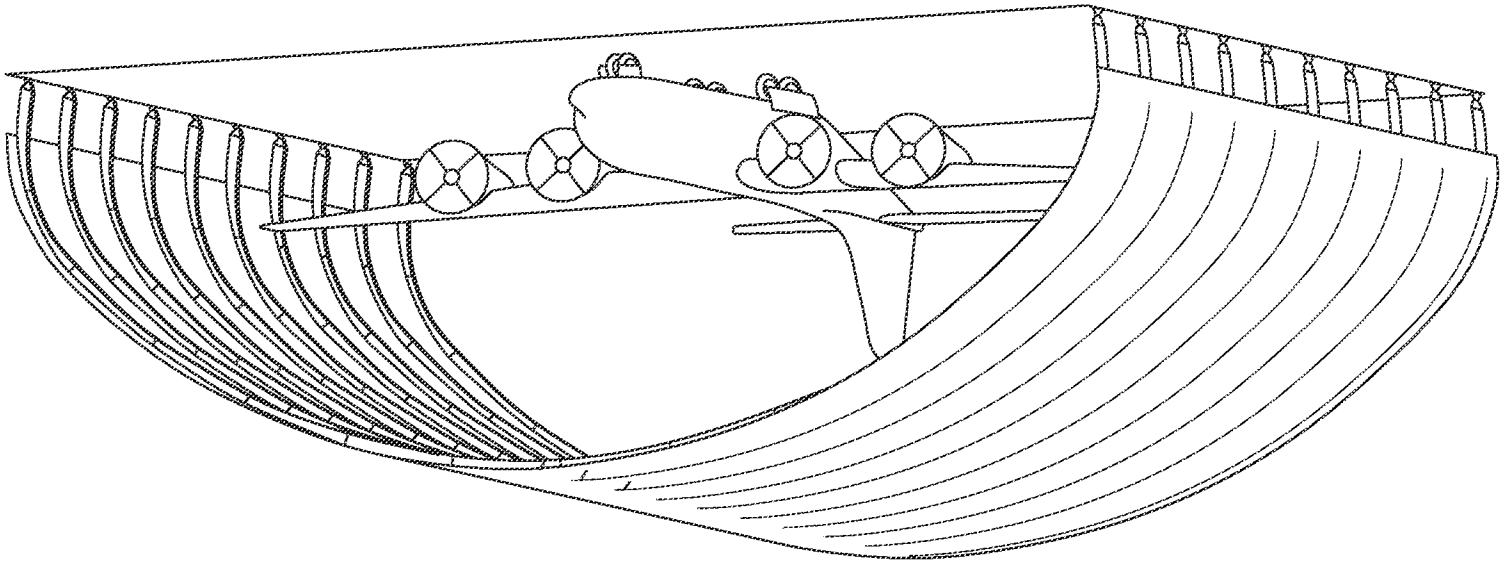
FIG. 8 shows a perspective view of a completed airplane hanger constructed according to an embodiment of the present invention.

FIG. 8 illustrates a perspective view of a completed airplane hanger constructed according to an embodiment of the present invention. The hanger comprises ten adjacent, parallel supporting arches that support a sheet steel roof that is 1,825 mm high at its peak, 33,000 mm long, and 47,650 mm wide.

Figure 9:
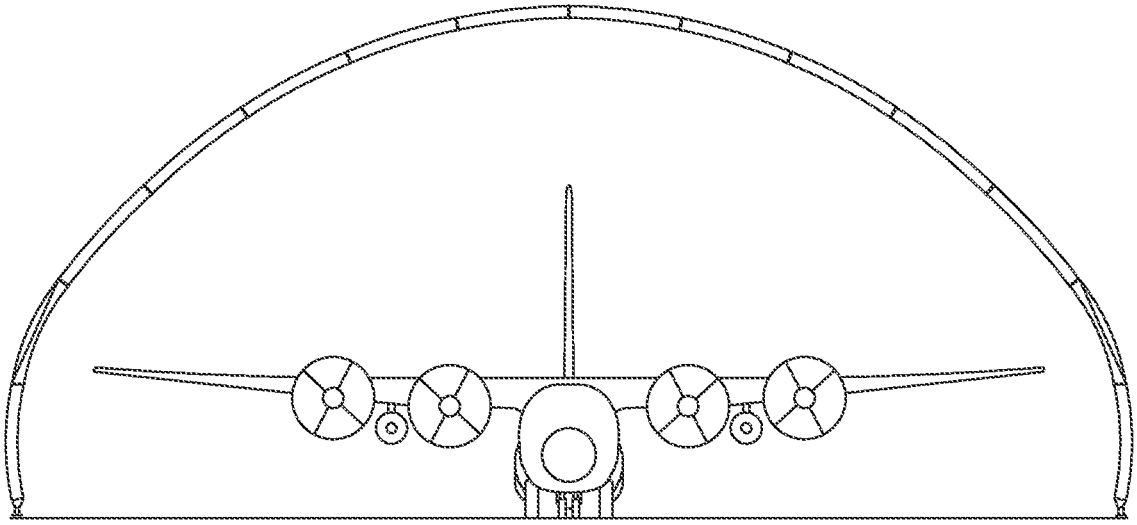
FIG. 9 shows an elevated end view of the hanger shown in FIG. 8.

FIG. 9 shows an elevated end view of the hanger shown in FIG. 8.

Figure 10:
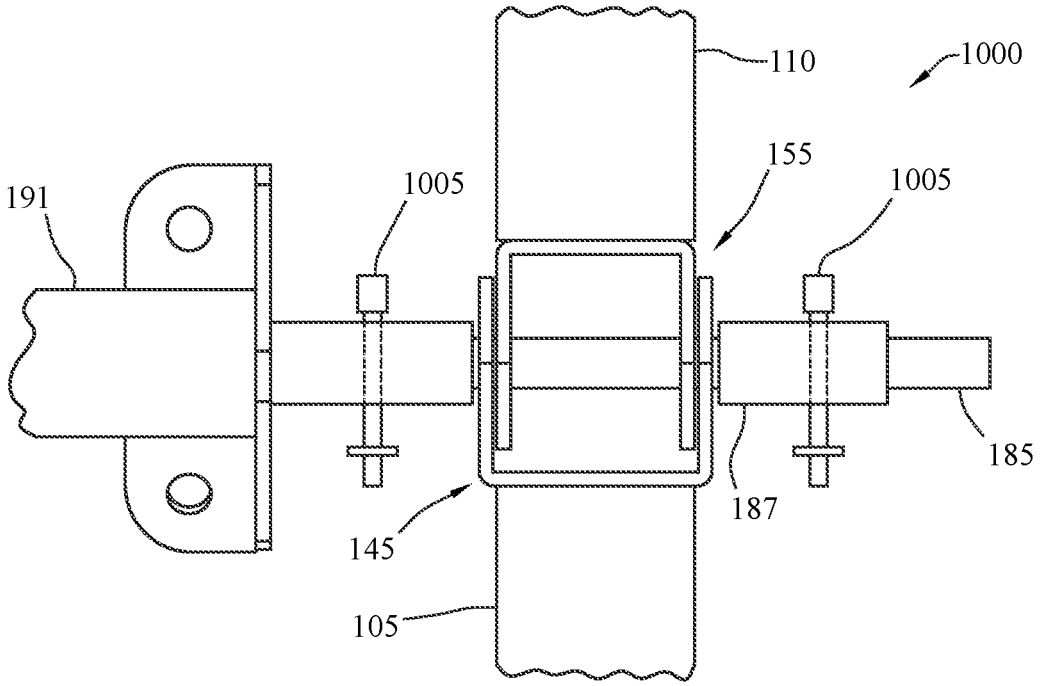
FIG. 10 shows a side view of a fully assembled clevis joint, according to some embodiments of the present invention.

FIG. 10 shows a side view of a fully assembled clevis joint 1000, according to some embodiments of the present invention. Retainers in the form of shaft locking pins 1005 are shown securing together the assembled clevis joint 1000.

Figure 11:
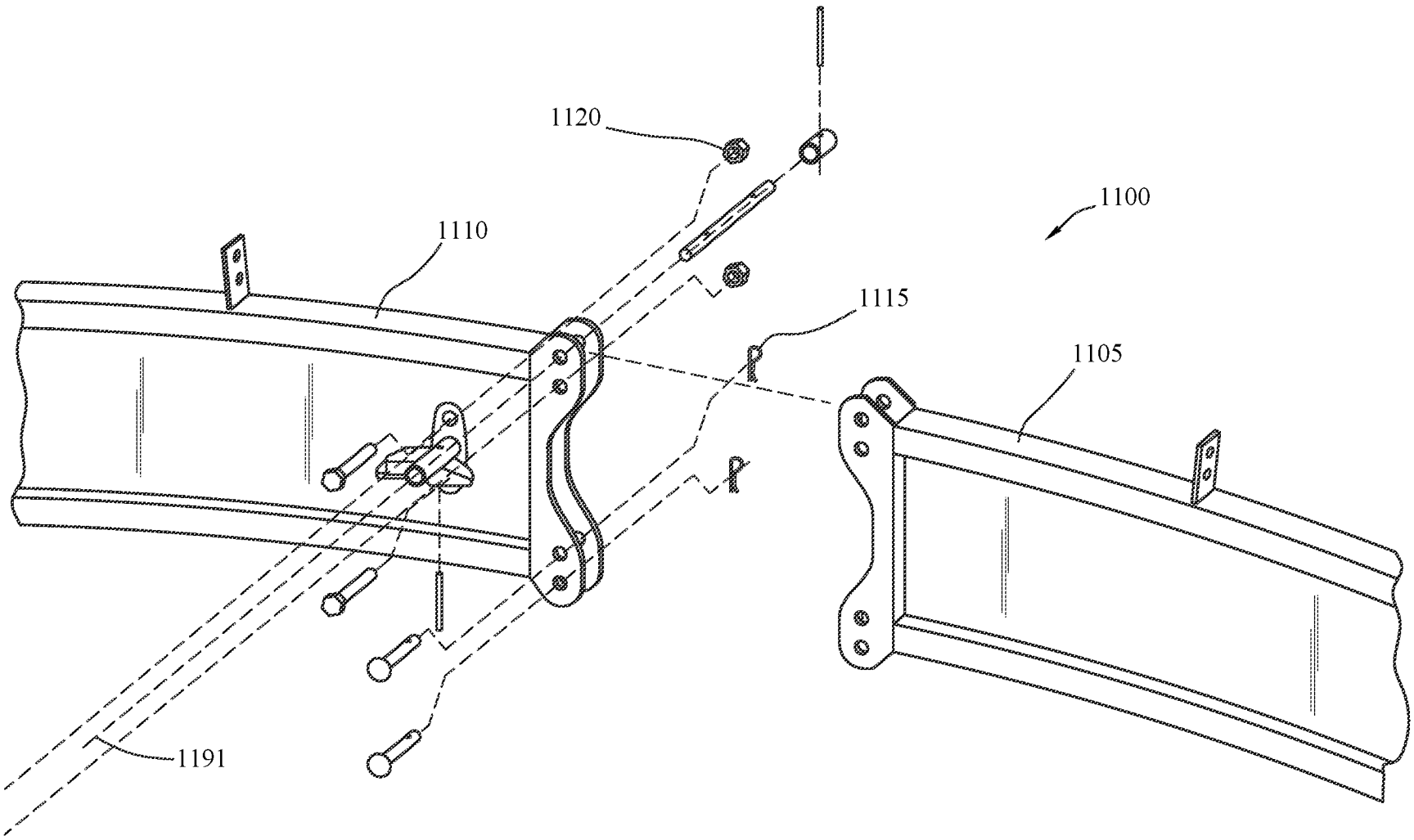
FIG. 11 shows a perspective view of an exploded, truncated section of a beam system constructed according to an alternative embodiment of the present invention.

FIG. 11 shows a perspective view of an exploded, truncated section of a beam system 1100 comprising a first structural element 1105 and a second structural element 1110, according to an alternative embodiment of the present invention. The structural elements 1105, 1110 are similar to the structural elements 105, 110; however, with the structural elements 1105, 1110 each clevis joint is connected together using two bolts rather than one. Each bolt is then held in place using a retainer such as an R-clip 1115 or a nut 1120. A stabilising member 1191, similar to the stabilising member 191, is also shown.

In summary, advantages of embodiments of the present invention include a beam system which, in use, can be connected to further beam systems simply and quickly, and without the need for expensive tools and equipment, overhead cranes or skilled labour resources, to define a supporting arch that is connected to adjacent, parallel supporting arches of a roofed structure.

The above description of various embodiments of the present invention is provided for purposes of description to one of ordinary skill in the related art. It is not intended to be exhaustive or to limit the invention to a single disclosed embodiment. Numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. Accordingly, this patent specification is intended to embrace all alternatives, modifications and variations of the present invention that have been discussed herein, and other embodiments that fall within the spirit and scope of the above described invention.

The invention claimed is:

1. A method comprising:

connecting a series of beams to each other, wherein the series of beams comprises a set of inner beams, a first end beam, and a second end beam opposite the first end beam in the series, wherein connecting the series of beams further comprises connecting interlocking upper clevis components of the set of inner beams, the first end beam, and the second end beam to each other;

lifting the series of beams, wherein lifting causes the series of beams to rotate relative to each other about the interlocking upper clevis components, and wherein lifting continues until lower clevis components of the inner beams, the first end beam, and the second end beam come into interlocking relationship with each other with corresponding opposing ends of the series of beams being proximate one another, wherein:

the upper clevis components and the lower clevis components of each beam form single channel clevis components having U-shapes, the upper clevis components comprise first tabs of the single channel clevis components, the lower clevis components comprise second tabs of the single channel clevis components, the second tabs opposing the first tabs, and the second tabs of the lower clevis components of the inner beams, the first end beam, and the second end beam are in direct contact with each other after lifting;

connecting the lower clevis components of the inner beams, the first end beam, and the second end beam to each other; and connecting the first end beam to a first footer and connecting the second end beam to a second footer.

2. The method of claim 1, further comprising:

attaching a stabilizing member to the series of beams.

3. The method of claim 2, further comprising:

attaching the stabilizing member to a second series of beams separated from the first series of beams.

4. The method of claim 3, wherein connecting the interlocking upper clevis components comprises placing clevis pins through coaxially aligned holes in the first tabs of the upper clevis components, and wherein the stabilizing member cooperates with one of the clevis pins.

5. The method of claim 1, wherein connecting the interlocking upper clevis components comprises placing clevis pins through coaxially aligned holes in the first tabs of the upper clevis components.

6. The method of claim 5, wherein connecting the lower clevis components comprises placing additional clevis pins through additional coaxially aligned holes in the second tabs of the lower clevis components.

7. The method of claim 5, wherein connecting the interlocking upper clevis components comprises further inserting the clevis pins into corresponding nuts.

8. The method of claim 1, wherein the first end beam comprises a first upper clevis component, a second lower clevis component, and a third clevis component, and wherein the third clevis component is connected to a post of the first footer.

9. The method of claim 1, wherein the first footer and the second footer are anchored to the ground.

10. The method of claim 1, wherein initially the series of beams are horizontally arranged and wherein lifting comprises:

pulling ones of the series of beams towards one another horizontally.

11. The method of claim 1, wherein lifting comprises first lifting innermost beams in the series of beams, and lifting the first end beam and the second end beam after all innermost beams in the series have been lifted.

12. The method of claim 1 wherein lifting the series of beams comprises lifting some of the series of beams prior to lifting others of the series of beams.

13. The method of claim 1, further comprising:

connecting roof sheeting to a common side of the series of beams.

14. The method of claim 1, wherein the series of beams are curved such that, after lifting, the series of beams form an arch.

* * * * *